United States Patent [19]

Ichida et al.

[11] 4,127,429

[45] Nov. 28, 1978

[54] FORSTERITE INSULATING FILMS FORMED ON SURFACE OF A GRAIN-ORIENTED SILICON STEEL SHEET HAVING A HIGH MAGNETIC INDUCTION AND A METHOD OF FORMING THE SAME

[75] Inventors: Toshio Ichida; Michiro Komatsubara, both of Chiba, Japan

[73] Assignee: Kawasaki Steel Corporation, Kobe, Japan

[21] Appl. No.: 810,379

[22] Filed: Jun. 27, 1977

[30] Foreign Application Priority Data

Jul. 5, 1976 [JP] Japan ..... 51-79720

[51] Int. Cl.[2] ..... H01F 1/04

[52] U.S. Cl. ..... 148/113; 148/12.1; 148/31.55

[58] Field of Search ..... 148/111, 112, 113, 31.5, 148/27, 31.55, 12.1; 427/127

[56] References Cited

U.S. PATENT DOCUMENTS

| | | | |
|---|---|---|---|
| 3,116,179 | 12/1963 | Carpenter et al. | 148/12.1 |
| 3,765,957 | 10/1973 | Hamachi et al. | 148/113 |
| 3,823,042 | 7/1974 | Boliing et al. | 148/112 |
| 3,940,299 | 2/1976 | Goto et al. | 148/111 |
| 3,945,862 | 3/1976 | Lee et al. | 148/31.5 |

*Primary Examiner*—R. Dean
*Assistant Examiner*—John P. Sheehan

[57] ABSTRACT

A forsterite insulating film having a good adhesion property to a grain-oriented silicon steel sheet with a high magnetic induction is composed of forsterite grains having a mean grain size of not more than 0.7 μm. The forsterite insulating film is formed by annealing a coil of a cold rolled silicon steel strip having a final gauge in an annealing furnace under an inert gas atmosphere at a constant temperature keeping stage of 800°-920° C so as to fully develop secondary recrystallized grains and then under hydrogen gas atmosphere at a temperature rising stage up to 1,150°-1,250° C and a constant temperature keeping stage of 1,150°-1,250° C during the final annealing, provided that an average dew point of the atmosphere is within a range of −20° C to +20° C in the temperature rising stage up to 1,150°-1,250° C and not more than +10° C in the constant temperature keeping stage of 1,150°-1,250° C.

1 Claim, 19 Drawing Figures

(X 10000)

(X10000)

(X 5000)

(X10000)

(X10000)

(X 10000)

(X 10000)

(X 10000)

(X 10000)

(X 10000)

(X 10000)

(X10000)

(X10000)

(X10000)

(X10000)

(X10000)

(X10000)

FORSTERITE INSULATING FILMS FORMED ON SURFACE OF A GRAIN-ORIENTED SILICON STEEL SHEET HAVING A HIGH MAGNETIC INDUCTION AND A METHOD OF FORMING THE SAME

This invention relates to forsterite insulating films formed on surface of a grain-oriented silicon steel sheet having a high magnetic induction and a method of forming the same.

It has been heretofore known that in the production of grain-oriented silicon steel sheets, the silicon steel strip cold-rolled into a desired final gauge is subjected to a decarburizing-annealing at a temperature of 700°–900° C. under wet hydrogen atmosphere to form subscales including $SiO_2$ and the like on the surface of the strip, coated with an annealing separator consisting mainly of MgO and then wound into a coil and thereafter the formed coil is subjected to a final annealing at an elevated temperature to form $MgO\text{-}SiO_2$ (forsterite) insulating film as described in, for example, U.S. Pat. No. 3,932,234 and No. 3,930,906.

According to the method described in U.S. Pat. No. 3,932,234, however, it is necessary to fully develop secondary recrystallized grains by constantly keeping the temperature within a range of 800° C. to 920° C. for several ten hours at the final annealing stage. As a result, the resulting $MgO\text{-}SiO_2$ film becomes very ununiform. Particularly, the whitish gray colored film having an inferior adhesion property to the silicon steel base metal is frequently formed in entire or partially on the steel sheet or the part having substantially no film is formed.

In order to improve these drawbacks, it has been proposed in U.S. Pat. No. 3,930,906 that an inert gas such as nitrogen, argon and the like is used as an annealing atmosphere gas during the final annealing at a constant temperature lying between 800° C. and 920° C. for several ten hours for fully developing the secondary recrystallized grains. However, even when the inert gas is used as the annealing atmosphere, the formed film is not sufficiently stabilized, so that the formation of $MgO\text{-}SiO_2$ film is incomplete. For instance, the films exhibit a tempered color or uniformly gray colored appearance over the surface of the steel sheet. In any case, the adhesion property is poor, so that these films have not yet been put to practical use.

An object of the invention is to provide forsterite insulating film and a method of forming the same, which eliminate and improve the above mentioned drawbacks of the conventional forsterite insulating film formed on the grain-oriented silicon steel sheet having a high magnetic induction.

A feature of the invention is that a mean grain size of forsterite grains constituting the forsterite insulating film is not more than 0.7 μm. Another feature of the invention is that in the final annealing stage, after the temperature is constantly kept within a range of 800° C. to 920° C. under an inert gas atmosphere, the inert gas is replaced with hydrogen gas, the temperature is raised to about 1,200° C. while maintaining an average dew point of the atmosphere contacting with the steel sheet within a range of −20° C. to +20° C. and is kept at about 1,200° C. for a given time while maintaining the average dew point of the atmosphere contacting with the steel sheet at not more than +10° C., provided that a period exposing to the atmosphere having a dew point higher than +10° C. is not more than 5 hours, whereby the insulating film composed of forsterite grains having a mean grain size of not more than 0.7 μm is formed.

The invention will now be described in greater detail with reference to the accompanying drawings, wherein:

FIG. 1 is a graph showing a relation between the adhesion property of forsterite insulating film and the mean grain size of forsterite grains;

FIGS. 2*a* and 2*b* are electron micrographs on surfaces of forsterite insulating films composed of coarse or fine forsterite grains by a surface replica method, respectively;

Figure 5A:
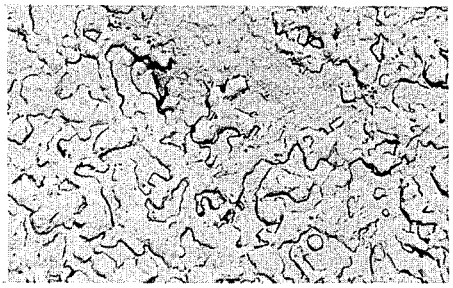
Figure 5B:
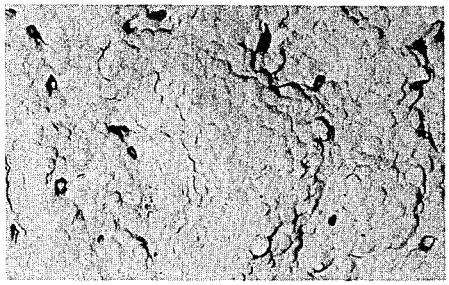
Figure 6A:
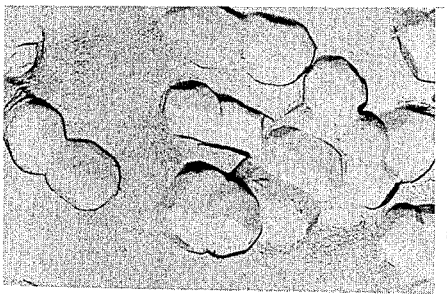
Figure 6B:
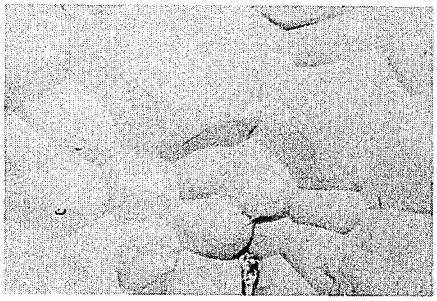
Figure 6C:
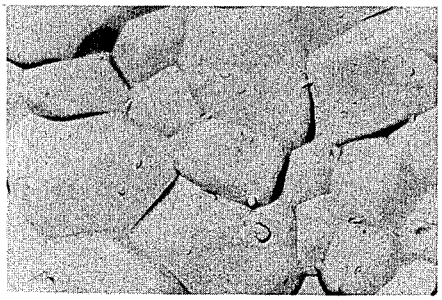
Figure 6D:
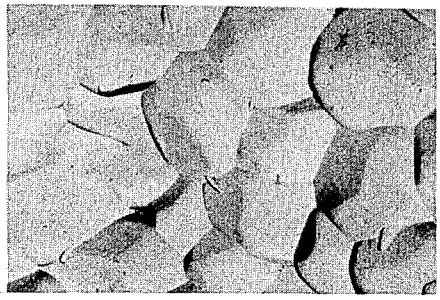
Figure 6E:
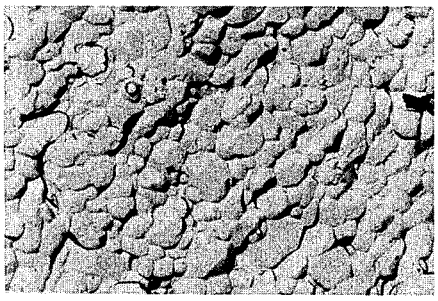
Figure 6F:
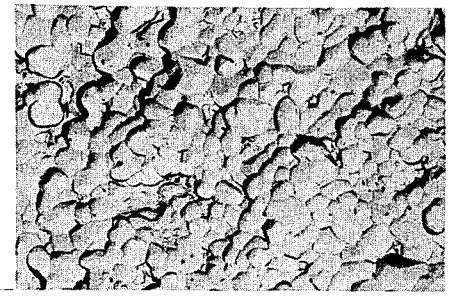
Figure 6G:
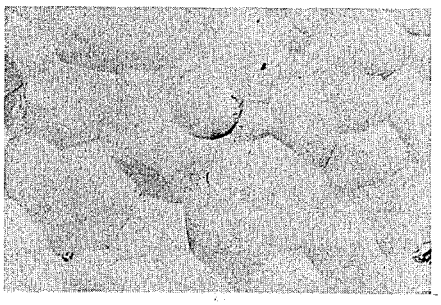
Figure 6H:
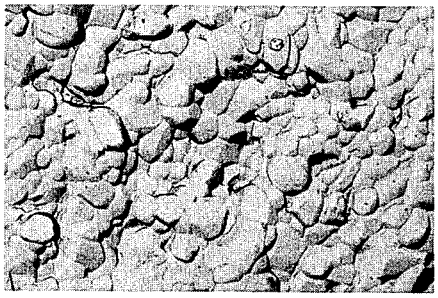
Figure 6I:
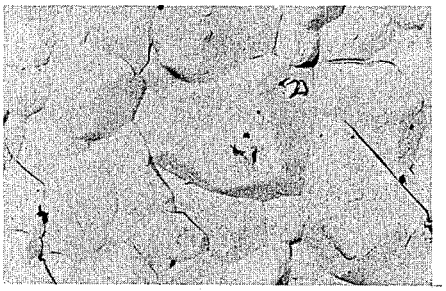
Figure 6J:
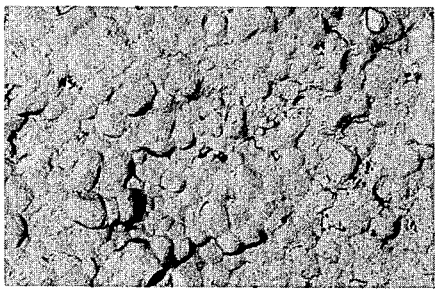
Figure 7A:
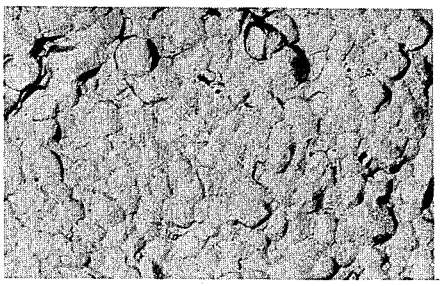
Figure 7B:
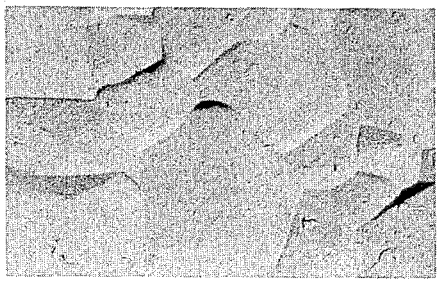

FIGS. 5*a* and 5*b* are electron micrographs on surfaces of the forsterite insulating films obtained in the following Experiment 1 by a surface replica method, respectively;

FIGS. 6*a* to 6*j* are electron micrographs on surfaces of the forsterite insulating films obtained in the following Experiment 2 by a surface replica method, respectively; and FIGS. 7*a* and 7*b* are electron micrographs on surfaces of the forsterite insulating films obtained in the following Experiment 3 by a surface replica method, respectively.

In general, the insulating film formed during final annealing process on the surface of the grain-oriented silicon steel sheet is composed of $MgO\text{-}SiO_2$ ceramic film formed by reacting $SiO_2$ formed near the surface of the sheet during the decarburizing-annealing with an annealing separator consisting mainly of MgO coated following to the decarburizing-annealing at the final annealing stage. An insulating phosphite film is usually coated and baked thereon. The inventors have found out from experimental results as mentioned below that the properties of the final product such as appearance, adhesion property of the film, interlaminar resistance and the like are considerably influenced by a dew point of an atmosphere contacting with the steel sheet during the temperature rising up to about 1,200° C. and the high-temperature annealing at about 1,200° C. after the inert gas is replaced with hydrogen gas following to the constant temperature keeping stage of 800°–920° C. in the final annealing step.

The $MgO\text{-}SiO_2$ ceramic film formed on the surface of the grain-oriented silicon steel sheet is constituted with a forsterite ($2MgO.SiO_2$) belonging to an orthorhombic system in crystallography. Upon the observation of the $MgO\text{-}SiO_2$ ceramic film by an electron microscope, it has been found that the adhesion property of the ceramic film is strongly influenced by the grain size of the forsterite grains constituting the ceramic film and particularly, the ceramic film composed of forsterite fine grains has a good adhesion property.

Figure 1:
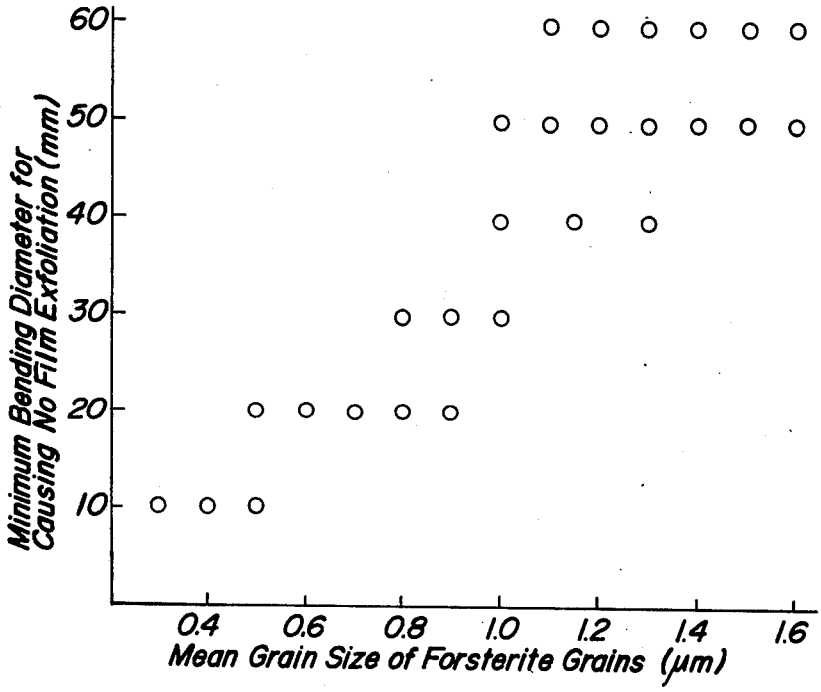

In FIG. 1 is shown a relation between the adhesion property of the ceramic film to the final annealed sheet of grain-oriented silicon steel having a high magnetic induction and the mean grain size of the forsterite grains constituting the ceramic film. The adhesion property of the forsterite ceramic film is estimated by a minimum bending diameter for causing no film exfoliation, which corresponds to a diameter of a steel rod when the final annealed silicon steel sheet is bent by 180° around the steel rod having a diameter of 10, 20, 30, 40, 50 or 60 mm. The mean grain size of the forsterite grains is calculated from 2,000 grains on the surface of the specimen observed from its electron micrograph by a surface replica method. In FIG. 1, an abscissa is the mean grain size in μm of the forsterite grains and an ordinate is the minimum bending diameter for causing no film exfoliation in mm as the adhesion property of the forsterite ceramic film.

In general, since the grain-oriented silicon steel sheets are subjected to a slit shearing or used as a wound core for a transformer and other electric devices, they are required to have the minimum bending diameter of not more than 20 mm as the adhesion property. In this connection, it can be seen from FIG. 1 that the mean grain size of the forsterite grains should be not more than 0.7 μm in order to obtain the adhesion property corresponding to the minimum bending diameter of not more than 20 mm.

Figure 2A:
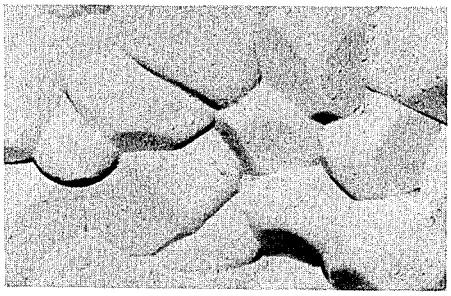
Figure 2B:
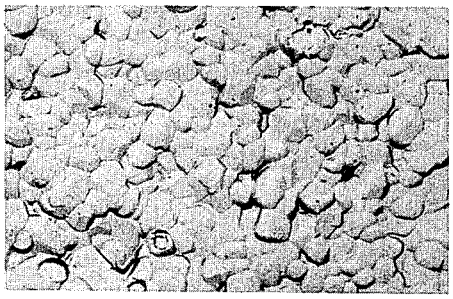
Figure 3:
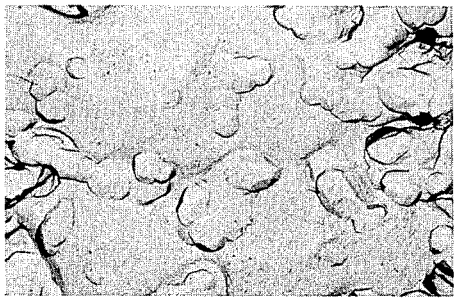
FIG. 3 is an electron micrograph on a surface of a forsterite insulating film insufficiently formed at the final annealing stage by a surface replica method.

In FIG. 2*a* is shown the electron micrograph on the surface of forsterite ceramic film composed of forsterite grains in FIG. 1 having a mean grain size of not less than 1.0 μm by a surface replica method. In FIG. 2*b* is shown the electron micrograph on the surface of forsterite ceramic film composed of forsterite grains in FIG. 1 having a mean grain size of not more than 0.7 μm by a surface replica method. In FIG. 3 is shown the electron micrograph on the surface of forsterite ceramic film insufficiently foimed on the grain-oriented silicon steel sheet at the final annealing thin a range stage, which exhibits a tempered color such as blue and red and is transparent to the crystal of the iron matrix, by a surface replica method. In the latter case, the surface of the iron matrix is not completely covered with the forsterite grains, i.e. relatively large forsterite grains are scattered over the surface of the iron matrix.

As mentioned above, it is clear that the appearance of the grain-oriented silicon steel sheet and the adhesion property of the insulating film to the sheet are considerably influenced by the microstructure of the forsterite ceramic film. Therefore, the inventors have made various studies with respect to a factor determining the microstructure of the forsterite ceramic film and as a result, it has been found out that an atmosphere between coil layers in the final annealing stage considerably influences on the microstructure of the forsterite ceramic film.

In general, the final annealing of the grain-oriented silicon steel sheet is carried out after the silicon steel strip having a width of 700–1,000 mm is coated with an annealing separator consisting mainly of MgO as a slurry, dried and wound into a coil. MgO is partially converted into magnesium hydroxide during the preparation of the slurry, and the dehydration is insufyers of the steel strip at the final annealing stage. The degree of water content evolved from the annealing separator can be guessed to a certain extent by measuring the change of dew point of an exhaust gas from the box furnace. However, it has been confirmed that the atmosphere gas contacting with the surface of the steel strip inside the coil is fairly different from the exhaust gas because the gas circulation frfm the outside of the coil to the inside thereof is not smooth enough.

The inventors have made the following experiments in extent by measuring with respect to the influence of the atmosphere between the coiled layers of the steel strip on the formation of the forsterite ceramic film by gas analysis between the coiled layers at the final annealing stage.

EXPERIMENT 1

Figure 4:
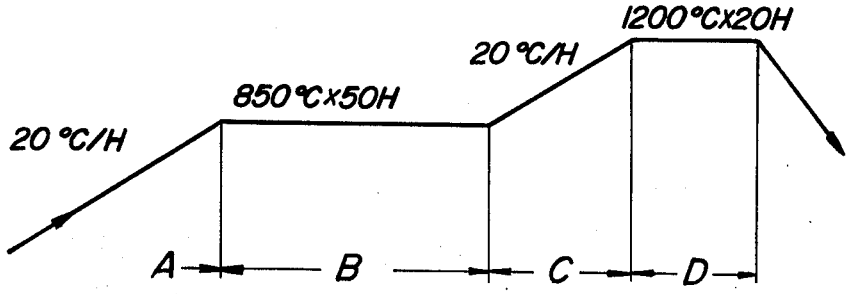
FIG. 4 is a diagram showing a standard heating program of the final annealing of the grain-oriented silicon steel sheet having a high magnetic induction.

The final annealing of the grain-oriented silicon steel sheet having a high magnetic induction was carried out according to a standard heating piogram shown in FIG. 4. The heating piogram can be classified into the following four heating stages (850° C. for the secondary recrystallization.

B: Constant temperature keeping stage of 850° C. for the secondary recrystallization.

C: Heating stage before an elevated temperature of 1,20° C. for the purif850° C. for the secondary recrystallization.

B: Constant temperature keeping stage of 850° C. for the secondary recrystallization.

C: Heating stage before an elevated temperature of 1,200° C. for the purification annealing.

D: Purification annealing stage at the elevated temperature of 1,200° C.

In this heating program, nitrogen gas was used as an annealing atmosphere at the stages A and B, and hydrogen gas was used as an annealing atmosphere at the stages C and D. Under such circumstances, the atmosphere between the coiled layers of the steel strip at the stage C and the microstructure of the steel surface just after the temperature reached to 1,200° C. were examined. In FIG. 5*a* is shown the electron micrograph of the steel surface by a surface replica method, wherein the temperature is raised up to 1,200° C. and an average dew point of the hydrogen atmosphere between the coiled layers is +40° C. at the stage C. In FIG. 5*b* is shown the electron micrograph of the steel surface by a surface replica method, wherein the temperature is raised up to 1,200° C. under hydrogen atmosphere having an average dew point of +20° C. between the coiled layers at the stage C. Moreover, the term "average dew point of the atmosphere between the coiled layers" used herein means a value obtained by arithmetically averaging the sum of dew points measured at 950° C., 1,000° C., 1,050° C., 1,100° C., 1,150° C. and 1,200° C. in the heating stage C.

As seen from FIG. 5*a*, when the average dew point of the atmosphere between the coiled layers is +40° C. or more at the stage C, the surface of the steel sheet just after the temperature reached to 1,200° C. is not completely covered with the forsterite grains, i.e. bare portions of the iron matrix are observed. As seen from FIG. 5*b*, when the average dew point at the stage C is +20° C. or less, the surface of the steel sheet just after the temperature reached to 1,200° C. is completely covered with the forsterite fine grains and in this case, there is not observed the significant growth of the forsterite grains as shown in FIG. 2*a*.

EXPERIMENT 2

The final annealing of the grain-oriented silicon steel sheet was carried out according to the heating program shown in FIG. 4 except that the average dew points of hydrogen atmosphere at the stages C and D were adjusted to values shown in the following Table 1, respectively. The appearance, adhesion property and interlaminar resistance of the thus obtained forsterite insulating film were measured to obtain results shown in Table 1.

Table 1

| Specimen | Average dew point (° C) Stage C | Stage D | Adhesion property Appearance | Inter-laminar resistance (mmϕ) | (Ωcm²/sheet) | Fig. 6 |
|---|---|---|---|---|---|---|
| A | 60 | 30 | The film exhibits a tempered color and is transparent to the grain of iron matrix | >60 | 0.2 | a |
| B | " | 10 | Uniformly gray, many bare spots | 60 | 1.2 | b |
| C | " | −20 | Uniformly gray, many bare spots | 60 | 1.3 | |
| D | 40 | 25 | The film exhibits a tempered color and is transparent to the grain of iron matrix | >60 | 0.3 | |
| E | " | 10 | Uniformly gray, many bare spots | 50 | 0.9 | |
| F | " | −20 | Uniformly gray, many bare spots | 50 | 1.5 | c |
| G | 20 | 30 | Uniformly gray, | 50 | 1.2 | d |
| H | " | 10 | Uniformly deep gray | 10 | 15.0 | e |
| I | " | −20 | Uniformly deep gray | 10 | 20.0 | |
| J | " | −30 | Uniformly deep gray | 10 | 25.5 | |
| K | 0 | 20 | Uniformly gray, many bare spots | 50 | 1.9 | |
| L | " | 0 | Uniformly deep gray | 10 | 16.3 | |
| M | " | −30 | Uniformly deep gray | 10 | 19.8 | f |
| N | −20 | 20 | Uniformly gray, many bare spots | 40 | 1.7 | g |
| O | " | 10 | Uniformly deep gray | 10 | 23.0 | |
| P | " | −20 | Uniformly deep gray | 10 | 20.5 | h |
| Q | −30 | 20 | Uniformly gray, many bare spots | 50 | 1.9 | i |
| R | " | 0 | Whitish gray, thin | 50 | 2.3 | |
| S | " | −20 | Whitish gray, thin | 50 | 1.8 | j |

In Table 1, the term "average dew point of the atmosphere at the stage D" means a value obtained by arithmetically averaging the sum of dew points measured every 1 hour during the purification annealing at 1,200° C. In FIGS. 6*a* to 6*j* are shown electron micrographs on the surfaces of typical examples of the final annealed sheet obtained in this experiment by a surface replica method, respectively.

It can be seen from Table 1 and FIGS. 6*a* to 6*j* that when the average dew point at the stage C is more than 40° C. and the average dew point at the stage D is more than 20° C., the surface of the final annealed sheet is not completely covered with the forsterite grains and bare portions of the iron matrix are observed (Specimens A and D, FIG. 6*a*). From this fact, it can be elucidated the factors of causing the phenomenon shown in FIG. 3 wherein the film exhibits a tempered color such as blue and red and is transparent to the grain of the iron matrix.

Even when the average dew point at the stage C is not less than 40° C., if the average dew point at the stage D is not more than 10° C., the surface of the final annealed sheet is covered with the forsterite grains (Specimens B, C, E and F, FIGS. 6*b* and 6*c*). However, the grain size of the forsterite is considerably large, and consequently the adhesion property of the film is poor.

When the average dew point at the stage C is within a range of −20° C. to +20° C. and the average dew point at the stage D is not more than 10° C., the surface of the final annealed sheet is completely covered with the forsterite grains having a fine grain size (Specimens H, I, J, L, M, O and P, FIGS. 6*e*, 6*f* and 6*h*), so that the adhesion property is good and the interlaminar resistance is high. On the contrary, even when the average dew point at the stage C is within a range of −20° C. to +20° C., if the average dew point at the stage D is not less than 20° C., the forsterite grains considerably grow, so that the adhesion property is deteriorated (Specimens G, K and N, FIGS. 6*d* and 6*g*).

When the average dew point at the stage C is −30° L C. and the average dew point at the stage D is not less than 20° C., the grain growth of forsterite is caused, so that the adhesion property is poor (Specimen Q, FIG. 6*i*). Further, when the average dew point at the stage C is −30° C. and the average dew point at the stage D is not more than 0° C., the resulting forsterite ceramic filmis whitish gray and has a relatively thin thickness and a low interlaminar resistance (Specimens R and S, FIG. 6*j*).

As mentioned above, although the average dew point at the stage C is within a range of −20° C. to +20° C., if the average dew point at the stage D is not less than 20° C., there are observed such common drawbacks that the adhesion property is considerably deteriorated due to the grain growth of forsterite and that there is caused a defect of the forsterite ceramic film, which is usually called as bare spot. The bare spots are observed on the surface of the final annealed sheet and correspond to spot portions with a diameter of 0.1 to 3 mm having no forsterite ceramic film. Owing to the presence of bare spots, not only the appearance is damaged, but also the interlaminar resistance is considerably deteriorated.

From this experiment, it can be seen that the desired properties of the forsterite ceramic film are first obtained when the average dew point at the stage C is maintained at a proper value lying between −20° C. and +20° L C. and the average dew point at the stage D is maintained at a value of not more than +10° C.

EXPERIMENT 3

The time causing the grain growth of forsterite when exposing to the atmosphere having a dew point higher than +10° C. at the stage D for a short period after the average dew point at the stage C was maintained at a proper value within the above mentioned range was measured every one hour in this experiment. The thus obtained results are shown in the following Table 2 and FIGS. *7a* and *7b*.

In FIG. *7a* is shown the electron micrograph on the surface of the final annealed sheet obtained under the conditions described in the middle column of Table 2 by a surface replica method. In FIG. *7b* is shown the electron micrograph on the surface of the final annealed sheet obtained under the conditions described in the lower column of Table 2 by a surface replica method.

Table 2

| Average dew point at stage C (° C) | Dew point at stage D | Average dew point at stage D (° C) | Appearance | Adhesion property (mmϕ) | Inter-laminar resistance (Ωcm²/sheet) | Remarks |
|---|---|---|---|---|---|---|
| 20 | 20° C × 3hr → 0° C × 17hr | 3 | Uniformly deep gray | 10 | 23.5 | |
| 20 | 20° C × 5hr → 0° C × 15hr | 5 | Uniformly deep gray | 10 | 18.0 | Fig. 7a |
| 20 | 20° C × 10hr → 10° C × 10hr | 10 | Gray, many bare spots | 50 | 1.3 | Fig. 7b |

As seen from Table 2, when the purification annealing is carried out under the conditions described in the top and middle columns of Table 2, the grain growth of forsterite is not caused, so that the adhesion property is improved and the interlaminar resistance becomes high. Therefore, it can be seen that even when the average dew point at the stage C is maintained at a proper value within the given range, the time for exposing to the atmosphere having a dew point higher than 20° C. at the stage D should be limited to not more than 5 hours.

As seen from the above, according to the invention, the mean grain size of the forsterite grains must be not more than 0.7 μm. When the mean grain size is more than 0.7 μm, the adhesion property is poor and the interlaminar resistance is low.

According to the invention, the average dew point of the atmosphere between the layers of the coil composed of the silicon steel strip must be within a range of −20° C. to +20° C. during the temperature rising up to 1,150°-1,250° C. When the average dew point is smaller than −20° C., bare spots are formed or the thickness of the film becomes thin and the interlaminar resistance is low, while when the average dew point is higher than +20° C., there are formed many bare spots and the adhesion property of the film and interlaminar resistance are deteriorated.

Further, according to the invention, the average dew point of the atmosphere between the layers of the coil composed of the silicon steel strip must be not more than +10° C. during the purification annealing at a temperature lying between 1,150° C. and 1,250° C., provided that the period exposing to the atmosphere having a dew point higher than +10° C. is limited to not more than 5 hours during the purification annealing. Beyond the above ranges, the ceramic film exhibits a tempered color and is transparent to the grain of the iron matrix, or there are formed many bare spots, so that the adhesion property of the film and interlaminar resistance are considerably deteriorated.

The invention will be described with reference to an example.

EXAMPLE

A silicon steel strip containing 0.025% of C, 2.90% of Si, 0.03% of Sb and 0.02% of Se and having a thickness of 0.3 mm, a width of 970 mm and a length of 3,200 m was continuously annealed in the atmosphere composed of 70% of $H_2$ and the remainder being $N_2$ and having a dew point of 60° C. at 820° C. for 4 minutes and coated with magnesia and then wound into a coil. The resulting coil was placed in an electric annealing box furnace and the temperature was raised at a rate of 20° C./hr while passing nitrogen gas and the temperature of 850° C. was kept for 50 hours and then nitrogen gas was replaced with hydrogen gas and the temperature was again raised to 1,200° C. at a rate of 20° C./hr, at which temperature the coil was annealed for 20 hours and then cooled in the furnace.

This procedure was carried out by changing the hydration, slurry temperature and applied amount of magnesia in the coating step, the strip tension for winding into coil, the amount and the dew point of gases passing through the annealing box furnace and controlling the atmosphere between the layers of the coil during the final annealing to obtain results shown in the following Table 3.

Table 3

| Average dew point at stage C (° C) | Average dew point at stage D (° C) | Appearance | Adhesion property (mmϕ) | Interlaminar resistance (Ωcm²/sheet) | Mean grain size forsterite grains constituting glass film (μm) | Remarks |
|---|---|---|---|---|---|---|
| 40 | 20 | The film exhibits a tempered color and is transparent to the grain of the iron matrix | >60 | 0.4 | 1.3 | control |
| " | 0 | Uniformly gray, many bare spots | 50 | 1.2 | 1.4 | control |
| 20 | 20 | Uniformly gray, many bare spots | 50 | 1.3 | 1.2 | control |
| " | 10 | Uniformly deep gray | 10 | 18.0 | 0.5 | present invention |
| " | −20 | Uniformly deep gray | 10 | 22.1 | 0.4 | present invention |
| −20 | −20 | Uniformly deep gray | 10 | 23.0 | 0.4 | present invention |

Table 3-continued

| Average dew point at stage C (° C) | Average dew point at stage D (° C) | Appearance | Adhesion property (mmϕ) | Interlaminar resistance ($\Omega cm^2$/sheet) | Mean grain size forsterite grains constituting glass film (μm) | Remarks |
|---|---|---|---|---|---|---|
| " | −30 | Uniformly deep gray | 10 | 22.8 | 0.3 | present invention |

As seen from Table 3, according to the invention, there can be provided the forsterite insulating film having a uniform thickness, a good adhesion property and a high interlaminar resistance.

What is claimed is:

1. In a method of producing a forsterite insulating film having a good adhesion property to a grain-oriented silicon steel sheet with a high magnetic induction, in which a cold rolled silicon steel strip having a desired final gauge, is subjected to decarburizing-annealing in wet hydrogen atmosphere at a temperature of 700°-900° C. to form subscale including $SiO_2$ on the surface of the strip, an annealing separator consisting mainly of MgO is coated on the decarburized strip, the thus treated strip is wound into a coil and the coiled strip is subjected to a final annealing by keeping the temperature at 800°-920° C. in a neutral gas atmsophere inert against iron and iron oxide so as to fully develop secondary recrystallized grains, and then raising and keeping the temperature at 1,150°-1,250° C. after said neutral gas is replaced with hydrogen gas, the improvement which comprises maintaining an average dew point of the atmosphere contacting with said coiled strip within a range of −20° C. to +20° C. during the temperature rising stage up to 1,150°-1,250° C., and maintaining an average dew point of the atmosphere contacting with said coiled strip at not more than +10° C. during the high temperature keeping stage at 1,150°-1,250° C., provided that a period exposing to the atmosphere having a dew point higher than +10° C. is not more than 5 hours, whereby said forsterite insulating film composed of forsterite grains having a mean grain size of not more than 0.7 μm is formed

* * * * *